United States Patent [19]

Jobmann

[11] Patent Number: 4,941,373

[45] Date of Patent: Jul. 17, 1990

[54] ROTARY OPENER AND CLOSER FOR SCREWS, SCREW CLOSURES ON BOTTLES, JARS AND THE LIKE

[76] Inventor: Wolfgang Jobmann, Gudrunstrasse 73, D-2000 Hamburg 56, Fed. Rep. of Germany

[21] Appl. No.: 385,410

[22] Filed: Jul. 27, 1989

[30] Foreign Application Priority Data

Sep. 9, 1988 [DE] Fed. Rep. of Germany ..... 3830684

[51] Int. Cl.[5] ..... B67B 7/18

[52] U.S. Cl. ..... 81/3.4

[58] Field of Search ..... 81/3.07, 3.4, 3.25, 81/3.43

[56] References Cited

U.S. PATENT DOCUMENTS

| | | | |
|---|---|---|---|
| 1,707,804 | 4/1929 | Haase | 81/3.4 |
| 1,853,735 | 4/1932 | Lawler | 81/3.4 |
| 3,084,573 | 4/1963 | Lipski . | |
| 3,143,904 | 8/1964 | Yerkes | 81/3.4 |
| 3,736,817 | 6/1973 | Huff . | |
| 3,760,657 | 9/1973 | Muir et al. | 81/3.4 |

FOREIGN PATENT DOCUMENTS

| | | | |
|---|---|---|---|
| 1950256 | 4/1971 | Fed. Rep. of Germany | 81/3.4 |
| 2111853 | 8/1972 | Fed. Rep. of Germany . | |
| 2117265 | 10/1972 | Fed. Rep. of Germany . | |
| 3830684 | 8/1989 | Fed. Rep. of Germany . | |
| 2030030 | 10/1970 | France . | |

*Primary Examiner*—Roscoe V. Parker

*Attorney, Agent, or Firm*—Staas & Halsey

[57] ABSTRACT

A rotary opener and closer for screws and in particular for screw closures on jars, bottles, etc. is described having two converging side walls perpendicular to the rotary plane in the use position and which are interconnected at the ends where they have their maximum spacing by an approximately semicircular side wall. To the inside of one side wall, preferably adjacent to the end remote from the semicircular side wall, is fixed a spring steel strip with a roughened surface. This spring steel strip engages internally on said side wall, on the connected semicircular side wall and on the opposite side wall. This provides a large area for gripping the screw closure to be opened, so that it is not excessively stressed and therefore damaged at one point. Taking account of the opening direction R, a fixing point is to be positioned to hold the steel strip in such a way that the spring steel strip is tensile stressed both on opening and closing, i.e. the rotary opener and closer must be correspondingly rotated by 180°, if it is to be transformed from an opener to a closer.

11 Claims, 1 Drawing Sheet

ROTARY OPENER AND CLOSER FOR SCREWS, SCREW CLOSURES ON BOTTLES, JARS AND THE LIKE

BACKGROUND OF THE INVENTION

The invention relates to a rotary opener and closer for screws, screw closures on bottles, jars and the like with two converging side walls (*2a, 2b*) which, in the use position, project vertically downwards from the rotary plane and which are interconnected at the ends at which they have their maximum spacing by an approximately semicircular side wall (*2c*), a rough surface for engagement on the edge of the workpiece (closure) being provided on the side wall or side walls.

U.S. Pat. No. 3,760,657 discloses a rotary opener, whose side walls converge in such a way that rotary closures or caps with different diameters can be opened. The rough surface is formed by teeth on one of the converging side walls. The facing converging side wall and the semicircular side wall are smooth, so that the force which is expended by the operator on turning the closure is transferred to a relatively small area on the edge of the closure to be opened. This can lead to an undesired deformation and damage to the closure.

SUMMARY OF THE INVENTION

The problem of the invention is to provide a rotary opener and closer of the aforementioned type, which permits a reliable opening of screw closures with different diameters and prevents damage to said screw closure.

This problem is fundamentally solved in that the rough surface is formed as a spring steel strip, which internally engages on the side walls and is only fixed to a side wall at one point.

The invention provides a tool which can be used both for opening and closing by turning or rotating the workpiece, e.g. a screw closure or cap on bottles.

Due to the fact that a separately constructed spring steel strip is provided which, due to the spring action, internally engages on the side walls and which has the roughened surface, a larger roughened surface is available on both sides and over a larger circumference of the edge of the screw closure to be opened. During the operation of the rotary opener the spring steel strip can engage on the edge of the screw closure to be opened and consequently ensures a large area for the torque transmission.

If in the case of the tool there are only side walls and no base plate connecting the same, it can be particularly appropriately used as a rotary opener and as a rotary closer. Both during closing and opening the spring steel strip is always tensile stressed. In order to ensure this tensile stressing, the rotary opener or closer is correspondingly placed on the workpiece, e.g. the screw closure, i.e. in such a way that tensile stressing always occurs.

If the tool is merely to be used as a rotary opener, then there is a base plate connecting the side walls, which only permits a "one-sided" engagement. A "turning round" for use also as a rotary closer is not then possible.

Advantageously fixing takes place so that the spring steel strip is always parallel to the side walls and cannot be turned with respect thereto.

The rough surface is advantageously formed by punched holes, such as is e.g. known in connection with kitchen graters.

BRIEF DESCRIPTION OF THE DRAWINGS

The invention is described in greater detail hereinafter relative to non-limitative embodiments and the attached drawings, wherein show.

DESCRIPTION OF THE PREFERRED EMBODIMENTS

Figure 1:
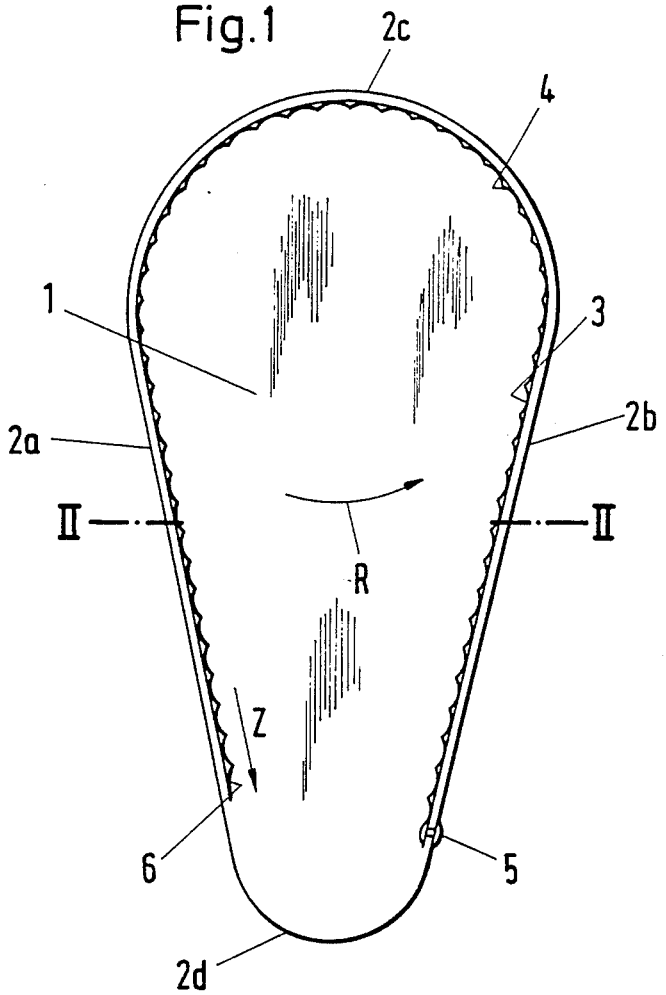
FIG. 1 A true-to-scale view of an embodiment of a rotary opener according to the invention viewed from below.
Figure 2:
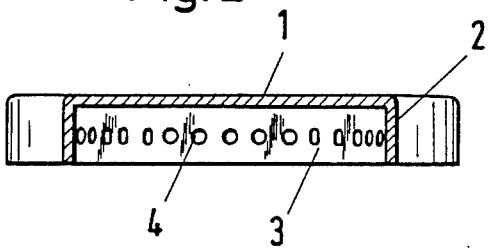
FIG. 2 A section along line II—II of FIG. 1.

The tool shown in the drawing is a rotary opener with a base plate 1, which forms the plane which, in the use position, is parallel to the not shown screw closure or cap to be opened. In the use position, two downwardly directed converging side walls *2a, 2b* emanate from base plate 1 and are interconnected at the ends having the greater spacing by a side wall *2c*, which is approximately semicircular.

A spring steel strip 3 is fixed to the end of side wall *2b*. The fixing point is designated 5. This spring steel strip passes from fixing point 5 on side wall *2b* over side wall *2c* to the end of the other converging side wall *2a* opposite to fixing point 5. As a result of the spring action the spring steel strip 3 tightly engages with the side walls. The spring steel strip has sharp-edged punched holes 4 in the manner of a kitchen grater and which form a roughened surface.

The rotation direction on opening a screw closure is designated R. The direction in which the spring steel strip is stressed and optionally displaced is designated Z.

For opening purposes the rotary opener is placed on the cover of a jar or the like, so that the side walls *2a* to *2d* point downwards and base plate 1 rests with its inside on the screw closure to be opened. The rotary opener is then moved relative to the screw closure to be opened until the spring steel strip 3 engages on both sides on the edge of the screw closure. Rotation then takes place in opening direction R, the spring steel strip engaging on both sides and gripping on both sides the screw closure to be opened. Therefore a relatively large area is available in which torque transmission takes place. The cover is stressed over a relatively large surface area, so that cover damage is avoided. As a result of the association of the fixing point 5 with the rotation direction R, the spring steel strip is always tensile stressed during opening.

The end on which the two converging side walls *2a, 2b* have their minimum spacing is dimensioned in such a way that it is also possible here to open small diameter screw closures, such as are e.g. provided on bottles.

In the embodiment not shown in the drawing, but which in practice has much the same appearance and which can be used both as a rotary opener and as a rotary closure, the base plate 1 is missing. The side walls are made correspondingly stiff, so that they fulfil their function. For opening purposes the tool is engaged in such a way that the spring steel strip is tensile stressed. If the tool is then to be used for closing, it is rotated by 180°, i.e. mounted the other way round, so that the spring steel strip is once again tensile stressed. This ensures that in no case does the spring steel strip form an undesired roll or loop.

The tool according to the invention makes it possible to open and close in a particularly advantageous manner screw closures and caps on bottles. It is also possible to loosen and tighten conventional screwable workpieces, such as screws or the like.

I claim:

1. Rotary opener and closer for screw closures, comprising:

two converging side walls, which project vertically downwards from a rotary plane in the use position and which are interconnected at ends where they have their greatest spacing by an approximately semicircular side wall; and a rough surface for engaging an edge of the closure being provided on at least one of the side walls, wherein the rough surface is formed on a spring steel strip, which internally engages on at least one of the side walls and is only fixed to one side wall at one fixing point.

2. Rotary opener and closer according to claim 1, wherein the fixing point of the spring steel strip is located at an end of the one side wall remote from the semicircular side wall (*2c*) which spring steel strip is tensile stressed during the rotation in the opening direction of the closure.

3. Rotary opener and closer according to claim 1, wherein the fixing point includes two opposing means for fixing the spring steel strip.

4. Rotary opener and closer according to claim 1, wherein the rough surface in the spring steel strip is formed by sharp-edged punched holes.

5. Rotary opener and closer according to claim 1, wherein the side walls are linked by a base plate parallel to the rotary plane in the use position.

6. Rotary opener and closer according to claim 2, wherein the fixing point includes two opposing means for fixing of the spring steel strip (3).

7. Rotary opener and closer according to claim 2, wherein the rough surface in the spring steel strip (3) is formed by sharp-edged punch holes.

8. Rotary opener and closer according to claim 3, wherein the rough surface in the spring steel strip (3) is formed by sharp-edged punch holes.

9. Rotary opener according to claim 2, wherein the side walls are linked by a base plate parallel to the rotary plane in the use position.

10. Rotary opener and closer according to claim 3, wherein the side walls are linked by a base plate parallel to the rotary plane in the use position.

11. Rotary opener and closer according to claim 4, wherein the side walls are linked by a base plate parallel to the rotary plane in the use position.

* * * * *